US012085076B2

(12) United States Patent
Qian et al.

(10) Patent No.: US 12,085,076 B2
(45) Date of Patent: Sep. 10, 2024

(54) SCROLL STRUCTURE AND COMPRESSOR WITH BACK PRESSURE PLATE AND FLOATING PLATE

(71) Applicant: GUANGDONG MIDEA ENVIRONMENTAL TECHNOLOGIES CORPORATION LIMITED, Guangdong (CN)

(72) Inventors: Canyu Qian, Guangdong (CN); Osamu Aiba, Guangdong (CN); Baiying Huang, Guangdong (CN); Bo Jiang, Guangdong (CN); Xiaolei Li, Guangdong (CN); Hidenobu Shintaku, Guangdong (CN)

(73) Assignee: GUANGDONG MIDEA ENVIRONMENTAL TECHNOLOGIES CORPORATION LIMITED, Guangdong (CN)

( * ) Notice: Subject to any disclaimer, the term of this patent is extended or adjusted under 35 U.S.C. 154(b) by 0 days.

(21) Appl. No.: 18/113,920

(22) Filed: Feb. 24, 2023

(65) Prior Publication Data

US 2023/0204033 A1 Jun. 29, 2023

Related U.S. Application Data

(63) Continuation of application No. PCT/CN2020/135085, filed on Dec. 10, 2020.

(30) Foreign Application Priority Data

Aug. 31, 2020 (CN) ..... 202010898728.6
Aug. 31, 2020 (CN) ..... 202021861162.1

(51) Int. Cl.
*F04C 18/02* (2006.01)
*F04C 27/00* (2006.01)
(Continued)

(52) U.S. Cl.
CPC ..... *F04C 18/0215* (2013.01); *F04C 18/0253* (2013.01); *F04C 27/008* (2013.01);
(Continued)

(58) Field of Classification Search
CPC ..... F04C 18/0215; F04C 18/0253; F04C 27/008; F04C 28/26; F04C 29/12; F04C 29/126
See application file for complete search history.

(56) References Cited

U.S. PATENT DOCUMENTS 8,037,702 B2 * 10/2011 Sato ..... F04C 28/26 417/44.2
8,517,703 B2 * 8/2013 Doepker ..... F04C 28/26 418/55.1
(Continued)

FOREIGN PATENT DOCUMENTS

CN 102384085 A 3/2012
CN 102762866 A 10/2012
(Continued)

OTHER PUBLICATIONS

International Search report dated May 26, 2021 received in International Application No. PCT/CN2020/135085.
(Continued)

*Primary Examiner* — Mary Davis
(74) *Attorney, Agent, or Firm* — SCULLY, SCOTT, MURPHY & PRESSER, P.C.

(57) ABSTRACT

A scroll structure and a compressor are provided. The scroll structure has a first scroll plate, a second scroll plate matching the first scroll plate, a back pressure plate and a floating plate. The first scroll plate and the second scroll plate can move relative to each other. A recess is provided at one end of the second scroll plate facing away from the first scroll plate. A first through hole is provided on the second scroll plate. The back pressure plate is arranged in
(Continued)

the recess. A gap is provided between the back pressure plate and a side wall of the recess. The floating plate is movably arranged on the back pressure plate. The floating plate covers the gap. A first chamber is formed among the second scroll plate, the back pressure plate and the floating plate. The first through hole is in communication with the first chamber.

9 Claims, 5 Drawing Sheets

(51) Int. Cl.
*F04C 28/26* (2006.01)
*F04C 29/12* (2006.01)

(52) U.S. Cl.
CPC ..... *F04C 28/26* (2013.01); *F04C 29/12* (2013.01); *F04C 29/126* (2013.01)

(56) References Cited

U.S. PATENT DOCUMENTS

| | | | | |
|---|---|---|---|---|
| 9,222,475 | B2 * | 12/2015 | Kim | F04C 18/0215 |
| 10,072,658 | B2 * | 9/2018 | Kim | F04C 18/0215 |
| 2009/0297380 | A1 | 12/2009 | Stover et al. | |
| 2010/0135836 | A1 | 6/2010 | Stover et al. | |
| 2011/0103988 | A1 | 5/2011 | Stover et al. | |
| 2012/0107163 | A1 | 5/2012 | Monnier et al. | |
| 2017/0241419 | A1 | 8/2017 | Jin et al. | |
| 2018/0216618 | A1 | 8/2018 | Jeong | |

FOREIGN PATENT DOCUMENTS

| | | | |
|---|---|---|---|
| CN | 106460842 | A | 2/2017 |
| CN | 211009078 | U | 7/2020 |
| CN | 111878393 | A | 11/2020 |
| KR | 101405326 | B1 | 6/2014 |
| KR | 101573598 | B1 | 12/2015 |

OTHER PUBLICATIONS

Request for the Submission of an Opinion dated Jun. 12, 2024 received in Korean Patent Application No. KR 10-2023-7005733.
Office Action dated Jun. 4, 2024 received in Canadian Patent Application No. CA 3, 188,704.
Supplementary European Search Report dated Feb. 1, 2024 received in European Patent Application No. EP 20951233.4.

* cited by examiner

Fig. 1 (-Prior Art-)

SCROLL STRUCTURE AND COMPRESSOR WITH BACK PRESSURE PLATE AND FLOATING PLATE

CROSS-REFERENCE TO RELATED APPLICATIONS

This application is a continuation application of PCT International Patent Application No. PCT/CN2020/135085, filed on Dec. 10, 2020, which claims priority to and benefits of Chinese Patent Application No. 202010898728.6, filed to China National Intellectual Property Administration on Aug. 31, 2020 and entitled "Scroll Structure and Compressor", and Chinese Patent Application No. 202021861162.1, filed to Chinese Patent Office on Aug. 31, 2020 and entitled "Scroll Structure and Compressor", the entire contents of each of which are incorporated herein by reference for all purposes. No new matter has been introduced.

FIELD

The present disclosure relates to the field of compressors, and particularly to a scroll structure and a compressor.

BACKGROUND

In the related art, as shown in FIG. 1, a scroll compressor 100' includes a casing 300', a discharge cover 400', a frame 500', a stationary scroll plate 220', a dynamic scroll plate 210', a back pressure plate 230' and a floating plate 240'.

The stationary scroll plate 220' and the dynamic scroll plate 210' together form a suction chamber, an intermediate pressure chamber and a discharge chamber, and the dynamic scroll plate 210' can move relative to the stationary scroll plate 220'.

In order to ensure adhesion between the stationary scroll plate 220' and the dynamic scroll plate 210', the back pressure plate 230' is arranged at the top of the stationary scroll plate 220', and the floating plate 240' is arranged on the back pressure plate 230'. The back pressure plate 230' and the floating plate 240' form a back pressure chamber 282', and the back pressure chamber 282' is in communication with the intermediate pressure chamber, and when the stationary scroll plate 220' and the dynamic scroll plate 210' together implement compression, pressure in the intermediate pressure chamber will be applied to the back pressure chamber 282' to push the floating plate 240'. Then, the floating plate 240' floats to abut against the discharge cover 400' of the compressor 100', to press the stationary scroll plate 220' towards the dynamic scroll plate 210'.

However, in such a structure, since the back pressure plate 230' is arranged at the top of the stationary scroll plate 220', the sealing performance of a position between the back pressure plate 230' and the stationary scroll plate 220' in communication with the outside is poor, and it is required to add a sealing ring 920'. In addition, if connecting points between the back pressure plate 230' and the stationary scroll plate 220' are far away from each other, the sealing performance of the sealing ring 920' will also be affected, resulting in poor sealing performance between the discharge chamber and the suction chamber and further affecting the performance of the compressor 100'.

SUMMARY

The present disclosure aims to solve at least one of the technical problems in the prior art.

Therefore, a first aspect of the present disclosure provides a scroll structure.

A second aspect of the present disclosure provides a compressor.

In view of this, according to an embodiment in the first aspect of the present disclosure, the present disclosure provides a scroll structure. The scroll structure includes: a first scroll plate; a second scroll plate matching the first scroll plate, where the first scroll plate and the second scroll plate may move relative to each other, a recess is provided at one end of the second scroll plate facing away from the first scroll plate, and a first through hole is provided on the second scroll plate; a back pressure plate arranged in the recess, where a gap is provided between the back pressure plate and a side wall of the recess; and a floating plate movably arranged on the back pressure plate, where the floating plate covers the gap, a first chamber is formed among the second scroll plate, the back pressure plate and the floating plate, and the first through hole is in communication with the first chamber.

According to the scroll structure provided in the present disclosure, the first scroll plate and the second scroll plate form a suction chamber, an intermediate pressure chamber and a discharge chamber, and when the first scroll plate and the second scroll plate implement compression, a refrigerant is sucked by the suction chamber, is compressed by the intermediate pressure chamber, and then is discharged into the discharge chamber, to complete compression.

Further, the recess is provided at one end of the second scroll plate facing away from the first scroll plate, the back pressure plate is arranged in the recess, the gap is provided between the back pressure plate and the side wall of the recess, and the floating plate covers the gap. Therefore, the first chamber is formed among the second scroll plate, the back pressure plate and the floating plate, the first through hole is further provided on the second scroll plate, and the first through hole is in communication with the first chamber. In some embodiments, the first through hole is in communication with the first chamber and the intermediate pressure chamber. Therefore, when the first scroll plate and the second scroll plate implement compression, the refrigerant in the intermediate pressure chamber provides pressure for the first chamber to move the floating plate, and when the floating plate is limited, the pressure in the first chamber forces the second scroll plate to move towards the first scroll plate, that is, the second scroll plate is pressed towards the first scroll plate. Further, sealing performance between the first scroll plate and the second scroll plate may be enhanced, the refrigerant is prevented from leaking, and compression efficiency is improved.

In addition, since the back pressure plate is arranged in the recess of the second scroll plate, an outer wall of the entire second scroll plate is integrated, further sealing performance between the discharge chamber and the suction chamber is enhanced, and compression efficiency is further improved.

Moreover, the scroll structure provided in the present disclosure may also have additional technical features as follows:

in an embodiment, the scroll structure further includes: a first sealing member arranged between the floating plate and the second scroll plate; and a second sealing member arranged between the floating plate and the back pressure plate.

In this embodiment, the first sealing member is arranged between the floating plate and the second scroll plate, and the second sealing member is arranged between the floating plate and the back pressure plate, and sealing performance of a joint between the floating plate and the second scroll plate, and a joint between the floating plate and the back pressure plate is ensured, leakage of the intermediate pressure chamber between the first scroll plate and the second scroll plate is avoided, and compression performance of the first scroll plate and the second scroll plate is ensured.

In an embodiment, further, the recess is a stepped recess, and a first stepped surface of the stepped recess is opposite the floating plate; and/or the back pressure plate has a stepped structure, and a second stepped surface of the stepped structure is opposite the floating plate.

In this embodiment, the floating plate is supported by the first stepped surface arranged on the second scroll plate, and a height of the floating plate is ensured, the floating plate may be conveniently limited, and the second scroll plate may be conveniently pressed. Similarly, the floating plate is supported by the second stepped surface arranged on the back pressure plate, and a height of the floating plate is ensured, the floating plate may be conveniently limited, and the second scroll plate may be conveniently pressed. The floating plate may be supported by the first stepped surface arranged on the second scroll plate and the second stepped surface arranged on the back pressure plate, and a height of the floating plate is ensured, the floating plate may be conveniently limited, and the second scroll plate may be conveniently pressed.

In an embodiment, further, the first scroll plate includes: a first plate body; and a first scroll wrap arranged on the first plate body and matching the second scroll plate.

In this embodiment, the first scroll plate includes the first plate body and the first scroll wrap, and the first scroll wrap may match the second scroll plate to implement compression.

In an embodiment, the second scroll plate further includes: a second plate body, where the recess is provided at one end of the second plate body facing away from the first scroll plate, a first through hole is provided on the second plate body, and a second through hole is further provided on the second plate body; and a second scroll wrap arranged at the other end of the second plate body facing away from the recess.

In this embodiment, the second scroll plate includes the second plate body and the second scroll wrap, and the recess and the second scroll wrap are arranged at two opposite ends of the second plate body respectively, and when the first chamber in the recess is filled with a refrigerant, the second scroll wrap may abut against the first scroll plate, to improve sealing performance between the first scroll plate and the second scroll plate.

The second through hole is used for discharging the refrigerant compressed by the first scroll plate and the second scroll plate.

In an embodiment, further, the back pressure plate includes: a back pressure body connected to the second scroll plate, where the gap is provided between at least part of an edge of the back pressure body and the side wall of the recess, and a third through hole is provided on the back pressure body; and a protrusion arranged around the third through hole and extending towards one side facing away from the first scroll plate.

In this embodiment, the back pressure plate includes the back pressure body and the protrusion, in some embodiments, the third through hole is provided on the back pressure body, and the protrusion is arranged around the third through hole. The third through hole is in communication with the second through hole, one side of the protrusion provides a moving rail for the floating plate, and the floating plate may move along the protrusion. The other side of the protrusion provides an extension channel for the second through hole, and the refrigerant discharged from the second through hole is led out, and compressed refrigerant may be conveniently discharged.

In an embodiment, the method further includes: a first check valve, where a fourth through hole is further provided on the second scroll plate, a second chamber is arranged at a position of the back pressure plate corresponding to the fourth through hole, and the first check valve is located in the second chamber and used for closing or opening the fourth through hole; and a fifth through hole is further provided on the back pressure plate, and the fifth through hole is in communication with the second chamber and the third through hole.

In this embodiment, the fourth through hole is provided on the second scroll plate, the second chamber is provided between the back pressure plate and the second scroll plate, and the fourth through hole is in communication with the second chamber. In some embodiments, the fourth through hole is connected to the second chamber and the intermediate pressure chamber, and an auxiliary discharge channel is arranged for the scroll structure, and the refrigerant compressed by the first scroll plate and the second scroll plate may be discharged through the fourth through hole or discharged through the fourth through hole and the second through hole simultaneously when the pressure of the refrigerant is low, to improve compression efficiency of the scroll structure.

In an embodiment, the scroll structure further includes: a screw for fixing the back pressure plate to the second scroll plate; and a third sealing member arranged between the back pressure plate and the second scroll plate.

In this embodiment, the third sealing member is arranged between the back pressure plate and the second scroll plate, and the back pressure plate is fixed on the second scroll plate by the screw, and sealing performance between the back pressure plate and the second scroll plate is improved, leakage between the first chamber and the second through hole is avoided, and a pushing effect of the first chamber on the second scroll plate is ensured.

In an embodiment, further, the floating plate includes: a floating plate body, where a sixth through hole is provided on the floating plate body, and the back pressure plate passes through the sixth through hole; and a supporting portion arranged on one side of the floating plate body facing away from the first scroll plate and arranged around the sixth through hole.

In this embodiment, the floating plate includes the floating plate body and the supporting portion. The sixth through hole is provided in the body, the back pressure plate passes through the sixth through hole, and the supporting portion is arranged around the sixth through hole, and the floating plate may conveniently support other components to limit the floating plate.

According to an embodiment in the second aspect of the present disclosure, the present disclosure provides a compressor. The compressor includes: a casing; a discharge cover arranged in the casing; a frame arranged in the casing, where the frame is spaced apart from the discharge cover are arranged; the scroll structure provided in any one of the above technical solutions, where a first scroll plate of the scroll structure is movably arranged on the frame; and a second check valve arranged on the second scroll plate and used for closing or opening a second through hole of the second scroll plate.

The compressor provided in the present disclosure includes the scroll structure provided in any one of the above technical solutions, and therefore has all beneficial effects of the scroll structure provided in any one of the above technical solutions, which will not be described in detail herein.

Additional aspects and advantages of the present disclosure will become obvious in the following description, or will be learned by practice of the present disclosure.

BRIEF DESCRIPTION OF THE DRAWINGS

The above and/or additional aspects and advantages of the present disclosure will become obvious and easy to understand from description of embodiments in combination with accompanying drawings as follows.

Figure 1:
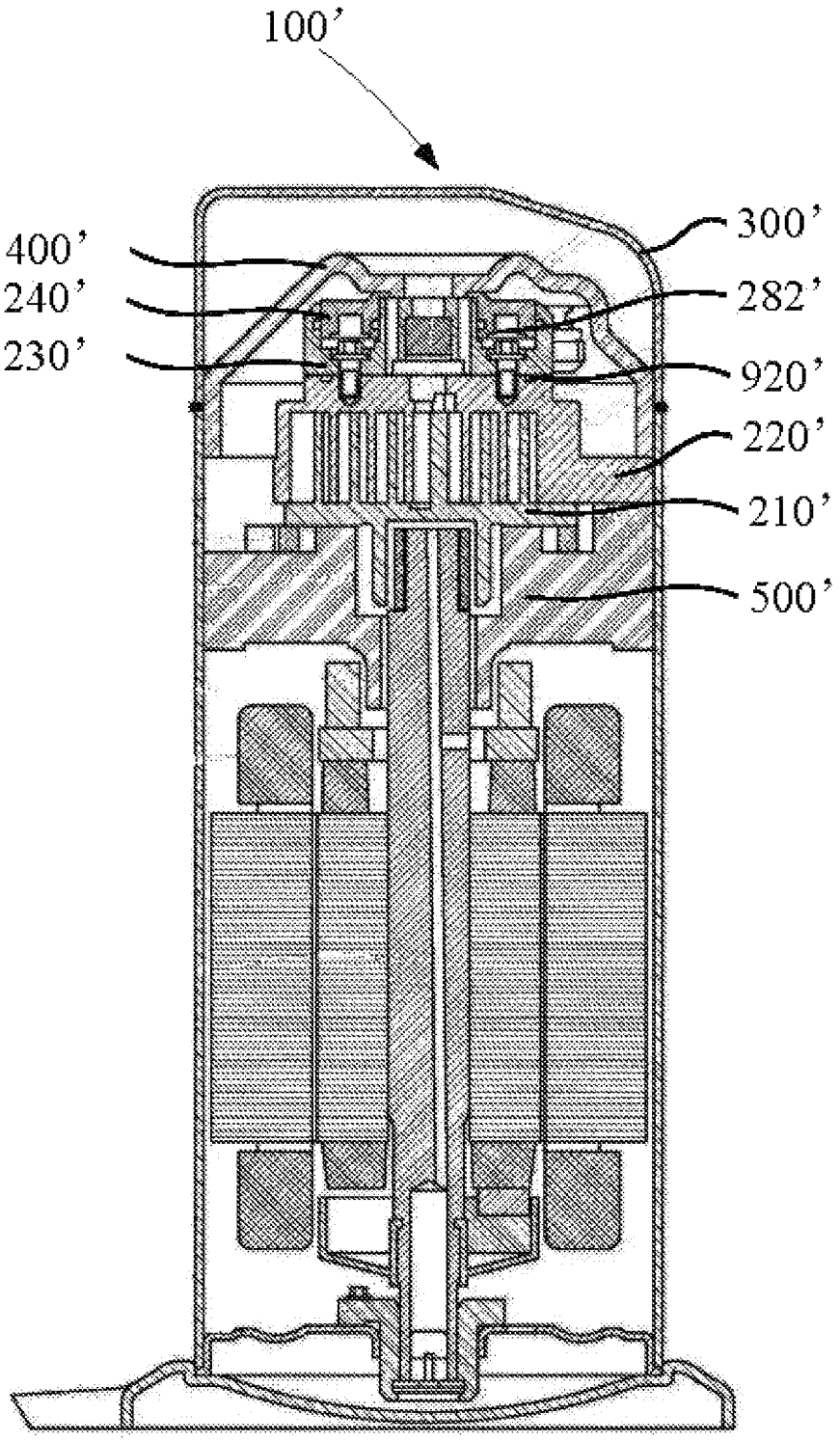
FIG. 1 is a schematic structural diagram of a compressor in the related art.

Corresponding relations between reference numerals in FIG. 1 and component names are as follows:

100' compressor, 300' casing, 400' discharge cover, 500' frame, 210' dynamic scroll plate, 220' stationary scroll plate, 230' back pressure plate, 240' floating plate, 282' back pressure chamber, and 920' sealing ring.

Corresponding relations between reference numerals in FIGS. 2 to 5 and component names are as follows:

100 compressor, 200 scroll structure, 210 first scroll plate, 212 first plate body, 214 first scroll wrap, 216 connecting portion, 220 second scroll plate, 222 second plate body, 2222 first through hole, 2224 second through hole, 2226 fourth through hole, 224 second scroll wrap, 226 recess, 2262 first wall, 230 back pressure plate, 232 back pressure body, 2322 third through hole, 234 protrusion, 2342 second wall, 240 floating plate, 242 floating plate body, 244 supporting portion, 250 first sealing member, 260 second sealing member, 270 first check valve, 282 first chamber, 284 second chamber, 286 suction chamber, 288 intermediate pressure chamber, 290 discharge chamber, 300 casing, 400 discharge cover, 500 frame, 510 first frame, 520 second frame, 600 second check valve, 610 slide way, 620 check plate, 700 discharge pipe, 710 third check valve, 800 suction pipe, 900 electric motor structure, 910 rotary shaft, and 920 third sealing member.

DETAILED DESCRIPTION OF DISCLOSURE

In order to more clearly understand the above objective, features and advantages of the present disclosure, the present disclosure will be further described in detail below in combination with accompanying drawings and particular embodiments. It should be noted that embodiments of the present disclosure and features in the embodiments can be combined with one another if there is no conflict.

Many specific details are set forth in the following description to facilitate full understanding of the present disclosure, but the present disclosure can also be implemented in other ways different from those described herein, and therefore the scope of protection of the present disclosure is not limited by the particular embodiments disclosed below.

A scroll structure 200 and a compressor 100 provided according to some embodiments of the present disclosure will be described below with reference to FIGS. 2 to 5.

Figure 2:
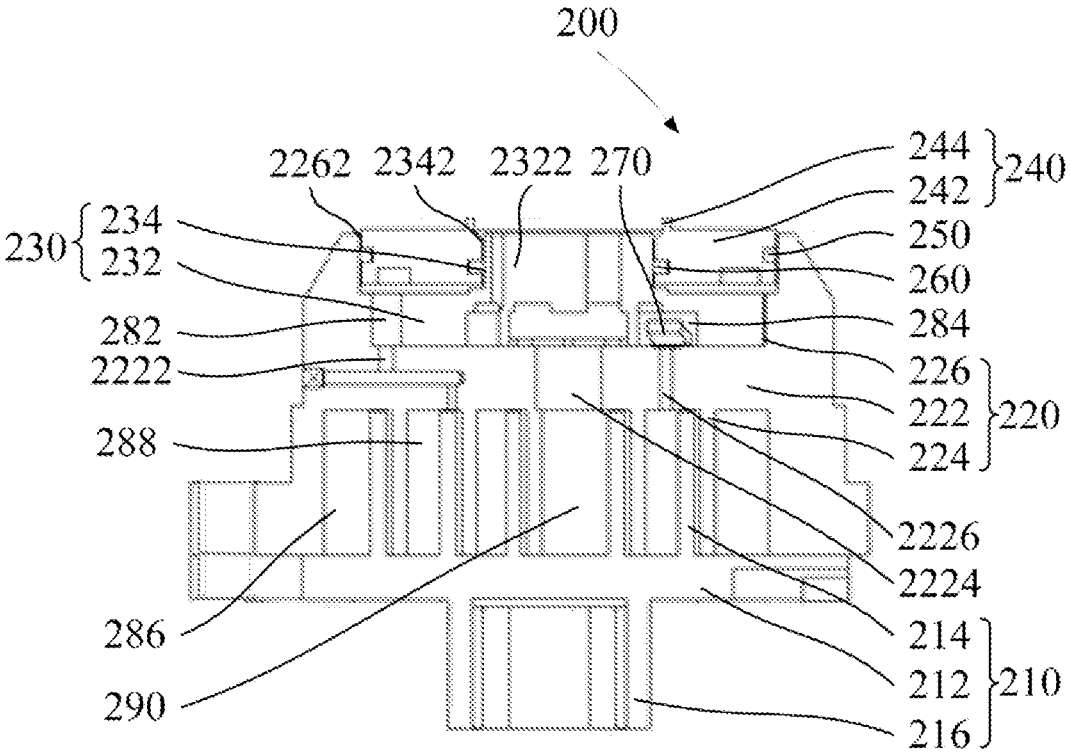
FIG. 2 is a schematic structural diagram of a scroll structure provided in an embodiment of the present disclosure.
Figure 3:
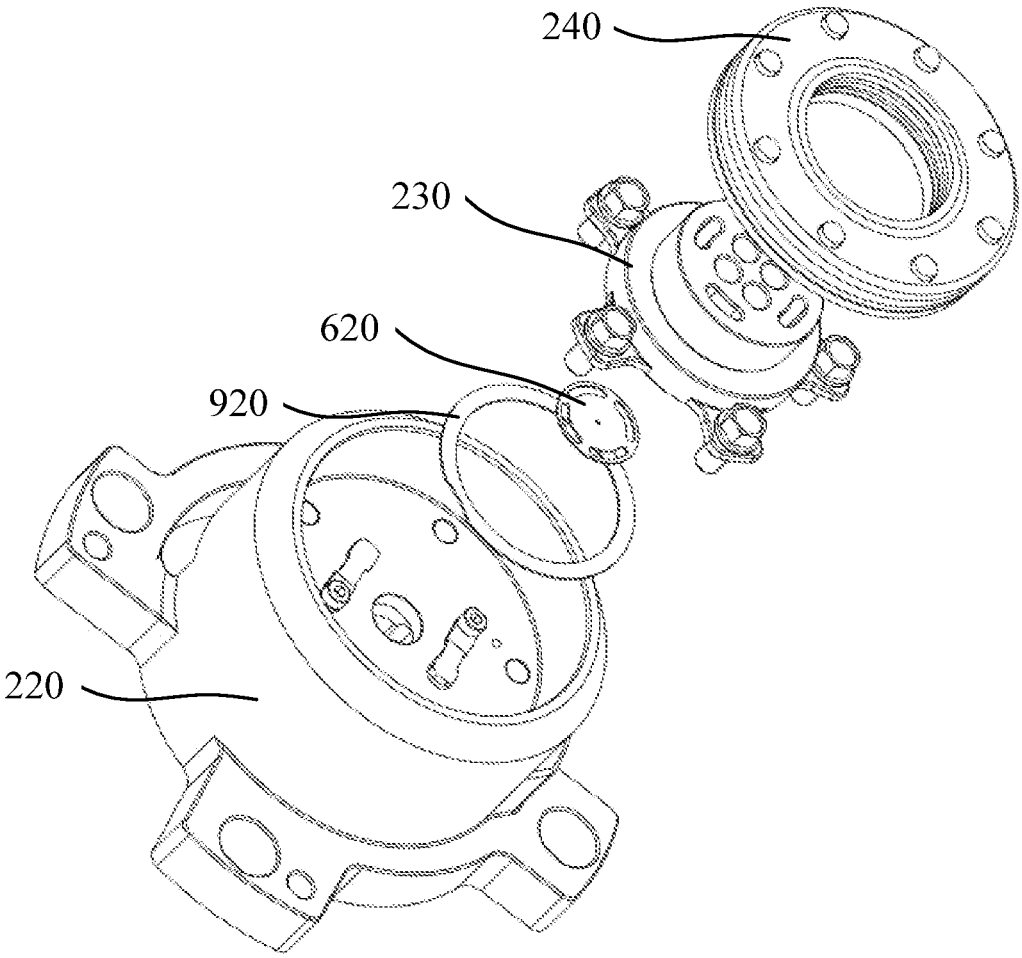
FIG. 3 is a schematic exploded diagram of part of a scroll structure provided in an embodiment of the present disclosure.

As shown in FIGS. 2 and 3, according to an embodiment in a first aspect of the present disclosure, an embodiment of the present disclosure provides a scroll structure 200 for a compressor 100. The scroll structure 200 includes: a first scroll plate 210 and a second scroll plate 220 matching the first scroll plate 210. The first scroll plate 210 may match the second scroll plate 220 to form a suction chamber 286, an intermediate pressure chamber 288 and a discharge chamber 290.

In some embodiments, the first scroll plate 210 is a dynamic state, and the second scroll plate 220 is a stationary state. When the first scroll plate 210 moves around a rotary shaft 910, a refrigerant is sucked in by the suction chamber 286, is compressed by the intermediate pressure chamber 288, and finally is discharged into the discharge chamber 290 to be discharged, to complete compression.

Further, the scroll structure 200 further includes: a back pressure plate 230 and a floating plate 240. A recess 226 is provided at one end of the second scroll plate 220 facing away from the first scroll plate 210, an inner side wall of the recess 226 is a first wall 2262, and the back pressure plate 230 is arranged in the recess 226. An outer side wall of the back pressure plate 230 is a second wall 2342, the first wall 2262 is opposite the second wall 2342, and a gap is provided between the first wall and the second wall. Two sides of the floating plate 240 are movably connected to the first wall 2262 and the second wall 2342 respectively, to form a first chamber 282 delimited by the second scroll plate 220, the back pressure plate 230 and the floating plate 240. A first through hole 2222 is further provided on the second scroll plate 220, and the first through hole 2222 is in communication with the first chamber 282 and the intermediate pressure chamber 288.

In some embodiments, when the first scroll plate 210 and the second scroll plate 220 implement compression, the refrigerant in the intermediate pressure chamber 288 is stressed to apply pressure to the first chamber 282 through the first through hole 2222, to force the floating plate 240 to move outwards. On this basis, movement of the floating plate 240 may be limited and the pressure in the first chamber 282 may act on the second scroll plate 220 to press the second scroll plate 220 towards the first scroll plate 210. Therefore, a tight connection between the first scroll plate 210 and the second scroll plate 220 is ensured, that is, independence of the suction chamber 286, the intermediate pressure chamber 288 and the discharge chamber 290 is ensured, and further compression effect and compression efficiency of the scroll structure 200 are improved.

In addition, since the back pressure plate 230 is arranged in the recess 226 of the second scroll plate 220, gaps of the first chamber 282 include a gap between the floating plate 240 and the second scroll plate 220, a gap between the floating plate 240 and the back pressure plate 230, and a gap between the back pressure plate 230 and the second scroll plate 220, that is, only three gaps are provided in the first chamber 282 of the scroll structure 200 provided in the present disclosure. With respect to a back pressure chamber in the related art, in addition to a gap between the floating plate 240 and the second scroll plate 220, and a gap between the floating plate 240 and the back pressure plate 230, two gaps are provided between the back pressure plate 230 and the second scroll plate 220. In contrast, gaps of the first chamber 282 in the scroll structure 200 provided in the present disclosure are reduced, and a sealing structure of the first chamber 282 is simplified, and production cost is reduced. Moreover, a sealing effect is improved, and compression efficiency of scroll structure 200 is ensured.

Further, the shape, structure and quantity of the first chamber 282 may be freely set according to requirements. In some embodiments, an annular first chamber 282 is arranged, that is, the first wall 2262 of the second scroll plate 220 is completely spaced apart from the second wall 2342 of the back pressure plate 230; a semi-annular first chamber 282 is arranged, that is, the first wall 2262 of the second scroll plate 220 is partially spaced apart from the second wall 2342 of the back pressure plate 230; or a plurality of first chambers 282 may be arranged, that is, the first wall 2262 of the second scroll plate 220 may be in partial contact with the second wall 2342 of the back pressure plate 230 in a spaced manner.

The shape, the structure and quantity of the first through hole 2222 may be freely set according to requirements. In some embodiments, three first through holes 2222 may be uniformly provided on the second scroll plate 220, to ensure uniform stress of the floating plate 240. Certainly, one, two, four or five first through holes, etc. may be provided in other embodiments of the present disclosure.

In some embodiments, one first chamber 282 is at least in communication with one first through hole 2222.

Further, the first wall 2262 and/or the second wall 2342 may be of an annular structure.

As shown in FIG. 2, on the basis of the previous embodiment, the scroll structure further includes: a first sealing member 250 arranged between the second scroll plate 220 and the floating plate 240. The first sealing member 250 is arranged between the floating plate 240 and the first wall 2262.

In some embodiments, the first sealing member 250 is a sealing ring.

As shown in FIG. 2, a mounting recess may be provided on the floating plate 240, one part of the first sealing member 250 is embedded in the mounting recess, and the other part thereof may abut against the second scroll plate 220, and the first sealing member 250 is pressed to implement sealing between the floating plate 240 and the second scroll plate 220. In some embodiments, the first sealing member 250 abuts against the first wall 2262 of the second scroll plate 220.

Certainly, a mounting recess may be provided on the second scroll plate 220, one part of the first sealing member 250 is embedded in the mounting recess, and the other part thereof may abut against the floating plate 240, and the first sealing member 250 is pressed to implement sealing between the floating plate 240 and the second scroll plate 220. In some embodiments, the mounting recess is provided on the first wall 2262 of the second scroll plate 220.

As shown in FIG. 2, on the basis of any one of the previous embodiments, the scroll structure further includes: a second sealing member 260 arranged between the back pressure plate 230 and the floating plate 240. The second sealing member 260 is arranged between the floating plate 240 and the second wall 2342.

In some embodiments, the second sealing member 260 is a sealing ring.

As shown in FIG. 2, a mounting recess may be provided on the floating plate 240, one part of the second sealing member 260 may be embedded in the mounting recess, and the other part thereof may abut against the back pressure plate 230, and the second sealing member 260 is pressed to implement sealing between the floating plate 240 and the back pressure plate 230. In some embodiments, the second sealing member 260 abuts against the second wall 2342 of the back pressure plate 230.

A mounting recess may be provided on the back pressure plate 230, one part of the second sealing member 260 may be embedded in the mounting recess, and the other part thereof may abut against the floating plate 240, and the second sealing member 260 is pressed to implement sealing between the floating plate 240 and the back pressure plate 230. In some embodiments, the mounting recess is provided on the second wall 2342 of the back pressure plate 230.

On the basis of any one of the previous embodiments, the recess 226 of the second scroll plate 220 is set as a stepped recess, and a first stepped surface of the recess 226 faces the floating plate 240. In some embodiments, a first stepped surface is arranged on the first wall 2262.

That is, the floating plate 240 may be supported by the first stepped surface in the recess 226. Therefore, the floating plate 240 is supported, and the floating plate 240 may be maintained at a specific position even pressure in the first chamber 282 is not reached. In some embodiments, when the scroll structure is applied to the compressor 100, the floating plate 240 abuts against the discharge cover 400 of the compressor 100 through the support of the first stepped surface, that is, the floating plate 240 abuts against the discharge cover 400 when not stressed, and after the floating plate 240 is stressed, the floating plate 240 may remain motionless. Further, the situation where the floating plate 240 jumps to collide with the discharge cover 400 is avoided, noise is reduced, and service life of the floating plate 240 and the discharge cover 400 is prolonged.

On the basis of any one of the previous embodiments, a stepped structure is arranged on the back pressure plate 230, and a second stepped surface on the back pressure plate 230 faces the floating plate 240. In some embodiments, the second stepped surface is arranged on the second wall 2342.

That is, the floating plate 240 may be supported by the second stepped surface of the back pressure plate 230. Therefore, the floating plate 240 is supported, and the floating plate 240 may be maintained at a specific position even pressure in the first chamber 282 is not reached. In some embodiments, when the scroll structure is applied to the compressor 100, the floating plate 240 abuts against the discharge cover 400 of the compressor 100 through the support of the second stepped surface, that is, the floating plate 240 abuts against the discharge cover 400 when not stressed, and after the floating plate 240 is stressed, the floating plate 240 may remain motionless. Further, the situation where the floating plate 240 jumps to collide with the discharge cover 400 is avoided, noise is reduced, and service life of the floating plate 240 and the discharge cover 400 is prolonged.

As shown in FIGS. 2 and 3, on the basis of any one of the previous embodiments, further, a stepped structure is arranged on the back pressure plate 230, and a second stepped surface on the back pressure plate 230 faces the floating plate 240. The recess 226 on the second scroll plate 220 is a stepped recess, and a first stepped surface of the recess 226 faces the floating plate 240. In some embodiments, the first stepped surface is arranged on the first wall 2262, and the second stepped surface is arranged on the second wall 2342.

That is, the floating plate 240 may be supported by the first stepped surface in the recess 226 and the second stepped surface of the back pressure plate 230. Therefore, the floating plate 240 is supported, and the floating plate 240 may be maintained at a specific position even pressure in the first chamber 282 is not reached. In some embodiments, when the scroll structure is applied to the compressor 100, the floating plate 240 abuts against the discharge cover 400 of the compressor 100 through the support of the second stepped surface, that is, the floating plate 240 abuts against the discharge cover 400 when not stressed, and after the floating plate 240 is stressed, the floating plate 240 may remain motionless. Further, the situation where the floating plate 240 jumps to collide with the discharge cover 400 is avoided, noise is reduced, and service life of the floating plate 240 and the discharge cover 400 is prolonged.

Further, a suction port is provided on a side wall of an outer circumference of the second scroll wrap 224, to suck a refrigerant to a position between the first scroll plate 210 and the second scroll plate 220.

As shown in FIG. 2, on the basis of any one of the previous embodiments, the first scroll plate 210 includes a first plate body 212 and a first scroll wrap 214 arranged on one side of the first plate body 212. The first scroll wrap 214 matches the second scroll plate 220 to implement compression.

Further, a connecting portion 216 is arranged at one end of the first plate body 212 facing away from the first scroll wrap 214, the connecting portion 216 is used for being connected to a rotary shaft 910 of an electric motor structure 900 of the compressor 100, to drive the first scroll plate 210 to rotate to complete compression.

As shown in FIG. 2, on the basis of any one of the previous embodiments, the second scroll plate 220 includes: a second plate body 222, a second scroll wrap 224 arranged at one end of the second plate body 222, and a recess 226 provided at one end of the second plate body 222 facing away from the second scroll wrap 224. A second through hole 2224 is further provided on the second plate body 222. In some embodiments, the second scroll wrap 224 matches the first scroll plate 210 to implement compression. More in some embodiments, the first scroll wrap 214 matches the second scroll wrap 224.

In this exemplary embodiment, the recess 226 and the second scroll wrap 224 are located at two opposite ends of the second plate body 222 respectively, and the first chamber 282 in the recess 226 is stressed to force the second plate body 222 to move towards the first plate body 212. This movement method has a short stroke, to ensure a sealing effect on the first scroll plate 210 and the second scroll plate 220.

A refrigerant compressed by the first scroll plate 210 and the second scroll plate 220 is discharged through the second through hole 2224 of the second plate body 222, that is, a refrigerant in the discharge chamber 290 is discharged. In some embodiments, when the scroll structure is used for the compressor 100, the second through hole 2224 is in communication with a discharge space of the compressor 100 and the refrigerant may be discharged from the compressor 100 through the discharge space.

In some embodiments, since a position of the first chamber 282 may not match a position of the intermediate pressure chamber 288, when the first through hole 2222 is formed, a hole may be transversely formed on the second plate body 222, and then holes are drilled on the position of the first chamber 282 and the position of the intermediate pressure chamber 288 respectively, and outlets of the holes are closed, to form the bent first through hole 2222. The method for forming the first through hole 2222 is simple and reliable.

As shown in FIG. 2, on the basis of any one of the previous embodiments, the back pressure plate 230 includes a back pressure body 232 and a protrusion 234 arranged at one side of the back pressure body 232. Moreover, a third through hole 2322 is provided on the back pressure body 232, and the third through hole 2322 is in communication with the second through hole 2224. The second wall 2342 is located on an outer circumferential side of the protrusion 234, and an inner circumferential side of the protrusion 234 surrounds the third through hole 2322.

In this exemplary embodiment, the protrusion 234 is of an annular structure, and the floating plate 240 is guided by the first wall 2262 on an outer side of the protrusion 234 and the floating plate 240 may conveniently move. Moreover, the refrigerant discharged from the second through hole 2224 is guided through the third through hole 2322 on an inner side of the protrusion 234 to flow to the discharge space of the compressor 100 and the refrigerant may be conveniently discharged.

As shown in FIG. 2, on the basis of any one of the previous embodiments, a second chamber 284, and a fifth through hole in communication with the second chamber 284 and the third through hole 2322 are further provided on one side of the back pressure plate 230 opposite the second scroll plate 220, a fourth through hole 2226 in communication with the second chamber 284 is further provided on the second scroll plate 220, and a first check valve 270 blocking the fourth through hole 2226 is further arranged in the second chamber 284. In some embodiments, the fourth through hole 2226 is in communication with the second chamber 284 and the intermediate pressure chamber 288, and the fifth through hole is in communication with the second chamber 284 and the discharge space of the compressor 100.

In this exemplary embodiment, an auxiliary refrigerant discharge channel is arranged on the scroll structure 200, that is, the refrigerant compressed by the first scroll plate 210 and the second scroll plate 220 passes through the discharge chamber 290 to be discharged through the second through hole 2224, moreover, part of the refrigerant passes through the intermediate pressure chamber 288 and the fourth through hole 2226 to enter the second chamber 284, and then flows into the third through hole 2322 through the fifth through hole to be discharged. Further, since the refrigerant in the discharge chamber 290 may not be completely discharged, or the refrigerant in the discharge chamber 290 may not be completely discharged, the refrigerant in the intermediate pressure chamber 288 may be discharged through the fourth through hole 2226, the second chamber 284 and the fifth through hole and the scroll structure 200 may adapt to different working conditions, and performance and efficiency of the scroll structure 200 are improved.

In some embodiments, the first check valve 270 may be a pressure opening valve, which is opened when pressure of the intermediate pressure chamber 288 reaches a predetermined threshold, to ensure a compression effect on the refrigerant.

Since the structure includes the second chamber 284, in order to ensure sealing performance of the entire structure, in this structure, the fourth through hole 2226 is required to be provided in the recess 226 to be in communication with the second chamber 284 and the third through hole 2322 through the fifth through hole of the back pressure plate 230. In addition, on the basis that the third through hole 2322 extends to the second through hole 2224, sealing performance of the entire scroll structure 200 may be further ensured.

On the basis of any one of the previous embodiments, the back pressure plate 230 and the second scroll plate 220 are connected to each other by a screw.

In some embodiments, a through hole is provided on the back pressure plate 230, a screw hole is provided on the second scroll plate 220, and the screw hole is a blind hole, to ensure sealing performance of the second scroll plate 220. Further, the screw penetrates the back pressure plate 230 to be in threaded connection to the second scroll plate 220, to fix the back pressure plate 230 and the second scroll plate 220.

In some embodiments, the quantity of the screw may be freely set according to actual situations, in some embodiments, one, two, three, four or five screws, etc. may be arranged. In order to secure sealing performance between the back pressure plate 230 and the second scroll plate 220, three or more screws may be arranged to secure sealing performance between the back pressure plate 230 and the second scroll plate 220.

As shown in FIG. 3, on the basis of any one of the previous embodiments, a third sealing member 920 is arranged between the back pressure plate 230 and the second scroll plate 220.

In some embodiments, third sealing member 920 is a sealing ring.

A mounting recess may be provided on the back pressure plate 230, one part of the third sealing member 920 is embedded into the mounting recess, and the other part of the third sealing member 920 abuts against the second scroll plate 220, and the third sealing member 920 is pressed to implement sealing between the back pressure plate 230 and the second scroll plate 220.

A mounting recess may be provided on the second scroll plate 220, one part of the third sealing member 920 is embedded into the mounting recess, and the other part of the third sealing member 920 abuts against the back pressure plate 230, and the third sealing member 920 is pressed to implement sealing between the back pressure plate 230 and the second scroll plate 220.

Mounting recesses may be provided on the second scroll plate 220 and the back pressure plate 230, and the third sealing member 920 is embedded into the mounting recesses, and when the second scroll plate 220 is in contact with the back pressure plate 230, the third sealing member 920 is pressed to implement sealing between the back pressure plate 230 and the second scroll plate 220.

As shown in FIG. 2, on the basis of any one of the previous embodiments, the floating plate 240 includes: a floating plate body 242 and a supporting portion 244 arranged at one end of the floating plate body 242. In some embodiments, a sixth through hole is provided on the floating plate body 242, and the sixth through hole sleeves the back pressure plate 230. More in some embodiments, the sixth through hole sleeves the protrusion 234 of the back pressure plate 230.

Moreover, when the scroll structure is applied to the compressor 100, the supporting portion 244 abuts against the discharge cover 400 of the compressor 100 to limit movement of the floating plate 240.

Figure 4:
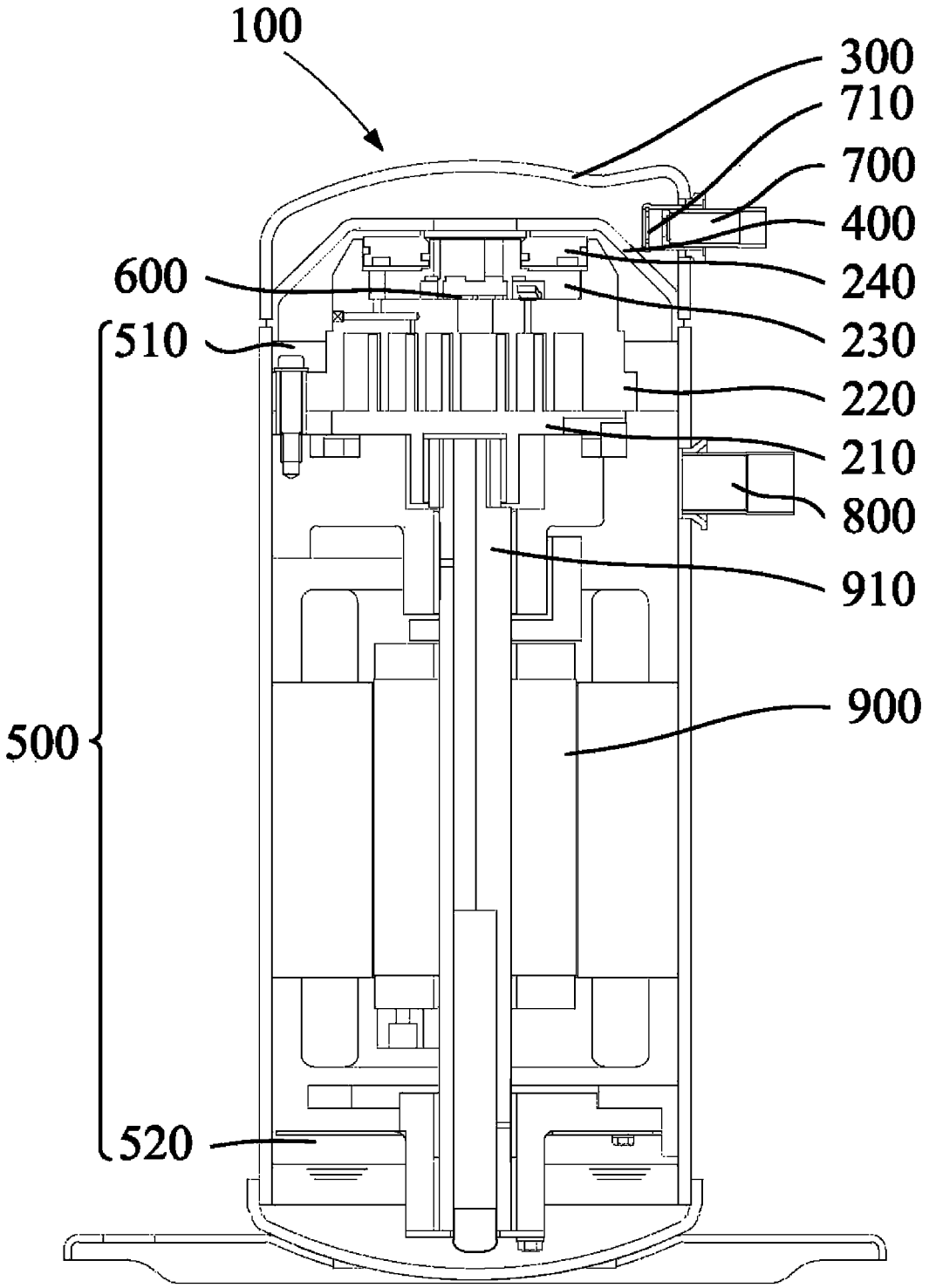
FIG. 4 is a schematic structural diagram of a compressor provided in an embodiment of the present disclosure.
Figure 5:
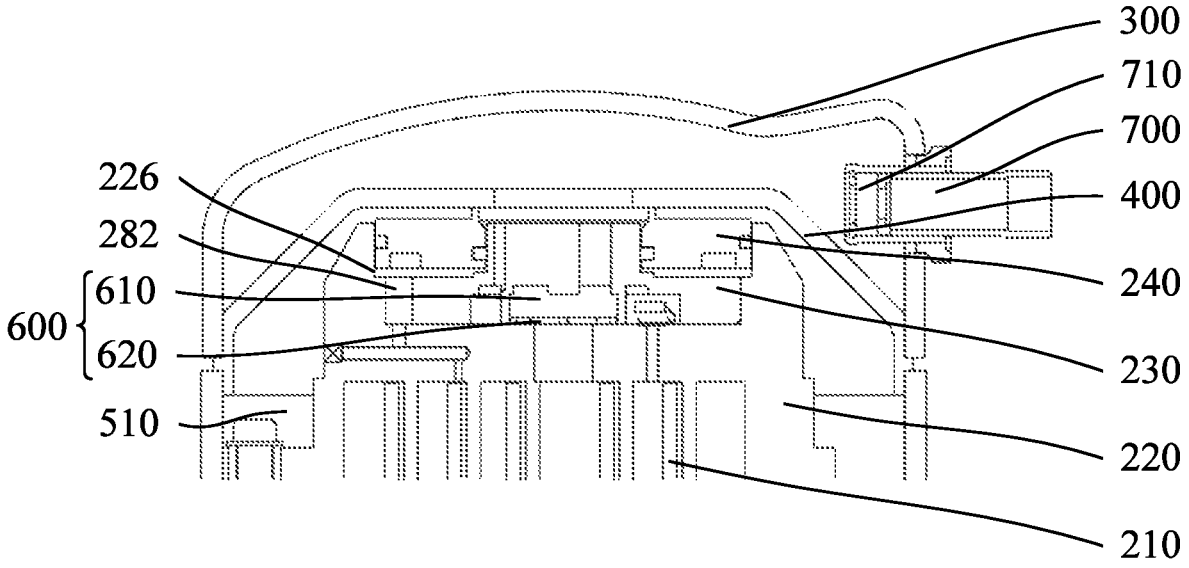
FIG. 5 is a schematic structural diagram of part of a compressor provided in an embodiment of the present disclosure.

As shown in FIGS. 4 and 5, according to an embodiment in the second aspect of the present disclosure, the present disclosure provides a compressor 100. The compressor includes: a casing 300, a discharge cover 400, a frame 500, a second check valve 600, and a scroll structure 200 provided in any one of the above embodiments.

In some embodiments, the discharge cover 400 and the frame 500 are arranged in the casing 300, and the discharge cover 400 is spaced apart from the frame 500. The discharge cover 400 divides an interior of the casing 300 into a suction space and a discharge space, the frame 500 is located in the suction space, and the scroll structure 200 is arranged on the frame 500. In some embodiments, the second scroll plate 220 may be fixed to the frame 500 by a screw, and the first scroll plate 210 may be in lap joint with the frame 500 and the first scroll plate 210 may move relative to the second scroll plate 220.

The second check valve 600 is arranged at the second through hole 2224 of the second scroll plate 220, to prevent a refrigerant in the discharge space from flowing back after the refrigerant is discharged from the scroll structure 200.

The compressor 100 provided in the present disclosure includes the scroll structure 200 provided in any one of the above embodiments, and therefore have all the advantages of the scroll structure 200 provided in any one of the above embodiments, which will not be described in detail herein.

As shown in FIG. 4, on the basis of the previous embodiment, the compressor 100 further includes an electric motor structure 900. The electric motor structure 900 is provided with a rotary shaft 910. The rotary shaft 910 is connected to the connecting portion 216 of the first scroll plate 210.

The frame 500 includes a first frame 510 and a second frame 520, the scroll structure 200 is arranged on the first frame 510, and the electric motor structure 900 is arranged on the second frame 520.

In this exemplary embodiment, the rotary shaft 910 of the electric motor structure 900 rotates to drive the first scroll plate 210 to move around the rotary shaft 910, to implement compression of the scroll structure 200.

As shown in FIG. 5, on the basis of the last two embodiments, the second check valve 600 is configured to be capable of being in communication with the second through hole 2224 and the discharge space.

In this exemplary embodiment, the second check valve 600 may be in communication with the second through hole 2224 and the discharge space. That is, after the refrigerant is discharged to the discharge space through the second through hole 2224, the residual refrigerant in the discharge space may return to a space between the first scroll plate 210 and the second scroll plate 220 through the second through hole 2224 under the action of pressure, to balance a pressure difference between the intermediate pressure chamber 288 between the first scroll plate 210 and the second scroll plate 220 and the discharge space. Thus, when the first scroll plate 210 and the second scroll plate 220 finish compression again and the refrigerant is discharged, the refrigerant may be smoothly discharged into the discharge space, to reduce resistance to discharge of the refrigerant and improve compression efficiency of the scroll compressor 100.

In some embodiments, the second check valve 600 includes a slide way 610 and a check plate 620. The check plate 620 may slide in the first slide way 610 and abut against the second scroll plate 220, and when the check plate 620 abuts against the second scroll plate 220, a passing area between the discharge space and the second through hole 2224 is reduced, to limit the quantity of the refrigerant discharged from the discharge space to the second through hole 2224. That is, the refrigerant in the discharge space does not flow back in a large quantity, and the quantity of refrigerant sucked by the first scroll plate 210 and the second scroll plate 220 is ensured, and compression efficiency is improved.

In some embodiments, a plurality of discharge ports may be provided on the check plate 620, and when the check plate 620 abuts against the second scroll plate 220, some of the discharge ports are blocked by the second scroll plate 220.

As shown in FIG. 4, on the basis of any one of the last three embodiments, a discharge pipe 700 and a suction pipe 800 are arranged on the casing 300.

A third check valve 710 is arranged on the discharge pipe 700.

In this exemplary embodiment, the compressor 100 further includes a discharge pipe 700 and a suction pipe 800, the discharge pipe 700 is in communication with the discharge space, and after the first scroll plate 210 and the second scroll plate 220 discharge the refrigerant to the discharge space, the refrigerant in the discharge space is discharged through the discharge pipe 700. In addition, the third check valve 710 is arranged on the discharge pipe 700, and after the refrigerant in the discharge space is discharged by the discharge pipe 700, the refrigerant is prevented from flowing back. Further, the discharge space is not in communication with a downstream apparatus, the quantity of the refrigerant in the discharge space is ensured to be constant, and a balance effect of a pressure difference between the discharge space and the first scroll plate 210 and the second scroll plate 220 is improved.

As shown in FIGS. 4 and 5, the compressor 100 provided in the present disclosure includes:

- a casing 300;
- a discharge cover 400, where the discharge cover 400 divides an inner space of the casing 300 into a suction space and a discharge space;
- a frame 500, where the frame 500 is spaced apart from the discharge cover 400;
- a first scroll plate 210 supported by a main frame 500, where the first scroll plate 210 is configured to move around the rotary shaft 910 during operation;
- a second scroll plate 220 forming a suction chamber 286, an intermediate pressure chamber 288, and a discharge chamber 290 together with the first scroll plate 210, where the first scroll plate 210 may move relative to the second scroll plate 220;
- a back pressure plate 230 connected to the second scroll plate 220, where a lower surface of the back pressure plate 230 faces an upper surface of the second scroll plate 220; and
- a floating plate 240 movably connected to the back pressure plate 230 and the second scroll plate 220, to seal an upper portion of the chamber, where the back pressure plate 230, the floating plate 240 and the second scroll plate 220 form a first chamber 282, and the first chamber 282 in communication with an intermediate pressure chamber 288 of the second scroll plate 220.

The back pressure plate 230 is in contact with the upper surface of an end plate of the second scroll plate 220, a protrusion 234 extends from the back pressure plate 230 to form an annular protrusion 234, an outer wall of the protrusion 234 is an annular second wall 2342 surrounding the third through hole 2322, and

- the floating plate 240 is connected to the back pressure plate 230 and the second scroll plate 220 and an outer circumferential surface of the protrusion 234, that is, the second wall 2342 is in contact with an inner circumferential surface of the floating plate 240.

The second scroll plate 220 forms a recess 226, and an inner side wall of the recess 226 forms a ring-shaped second wall 2342, and an inner circumferential surface of the second ring-shaped wall is in contact with an outer circumferential surface of the floating plate 240.

According to the compressor 100 provided in the present disclosure, a sealing ring between the lower surface of the back pressure plate 230 and the upper surface of the second scroll plate 220 is required to seal exhaust pressure and intermediate pressure with a small sealing pressure difference, and a structure of a sealing gasket is simplified, and sealing reliability is improved. Moreover, a position of the fourth through hole 2226 may be freely set.

The present disclosure provides a scroll structure 200 and a compressor 100. The compressor 100 may include a casing 300, a discharge cover 400, a frame 500, a first scroll plate 210 supported by the frame 500, and a second scroll plate 220 forming a suction chamber 286, an intermediate pressure chamber 288, and a discharge chamber 290 together with the first scroll plate 210. The compressor 100 may further include a back pressure plate 230 connected to the second scroll plate 220. The compressor 100 may further include a floating plate 240 movably connected to the back pressure plate 230 and the second scroll plate 220 to seal the floating plate at an upper portion of the first chamber 282. The back pressure plate 230, the floating plate 240 and the second scroll plate 220 form a first chamber 282, and the back pressure chamber is in communication with the intermediate pressure chamber 288 of the second scroll plate 220.

In the present disclosure, terms "first", "second" and "third" are merely used for a descriptive purpose and cannot be understood as indicating or implying relative importance; and term "plurality of" refers to two or above, unless explicitly defined otherwise. Terms "mounted", "connected to each other", "connected to", "fixed", etc. should be understood in a broad sense. In some embodiments, "connected to" can mean a fixed connection, a detachable connection, or an integrated connection; and "connected to each other" can mean a direct connection, or an indirect connection by an intermediary. For those of ordinary skill in the art, the specific meanings of the above terms in the present disclosure can be understood according to specific circumstances.

In the description of the present disclosure, it should be understood that the orientation or positional relations indicated by terms "up", "down", "left", "right", "front", "rear", etc. are based on the orientation or positional relationships shown in accompanying drawings, are merely for facilitating the description of the present disclosure and simplifying the description, rather than indicating or implying that a device or unit referred to must have a particular orientation or be constructed and operated in a particular orientation, and therefore cannot be understood as limiting the present disclosure.

In the description, terms "an embodiment", "some embodiments", "particular embodiments", etc. mean that a specific feature, structure, material or characteristic described in combination with the embodiment or instance is included in at least one embodiment or instance of the present disclosure. In the description, the schematic descriptions of the above terms do not certainly refer to the same embodiment or instance. Moreover, the specific features, structures, materials or characteristics described can be combined in an appropriate manner in any one or more embodiments or instances.

What are mentioned above are merely preferred embodiments of the present disclosure, and are not intended to limit the present disclosure, and various modifications and changes can be made on the present disclosure by those skilled in the art. Any modification, equivalent substitution, improvement, etc. within the spirit and principles of the present disclosure should fall within the scope of protection of the present disclosure.

What is claimed is:

1. A scroll structure comprising:

a first scroll plate;

a second scroll plate matching the first scroll plate, wherein the first scroll plate and the second scroll plate are movable relative to each other, a recess is provided at one end of the second scroll plate facing away from the first scroll plate, and a first through hole is provided on the second scroll plate;

a back pressure plate arranged in the recess, wherein a gap is provided between the back pressure plate and a side wall of the recess; and a floating plate movably arranged on the back pressure plate, wherein:

the floating plate covers the gap, a first chamber is formed among the second scroll plate, the back pressure plate, and the floating plate, and the first through hole is in communication with the first chamber, wherein the recess comprises a first stepped surface, and the floating plate is supported by the first stepped surface, and wherein the back pressure plate comprises a stepped structure, and the floating plate is supported by the stepped structure.

2. The scroll structure according to claim 1, further comprising:

a first sealing member arranged between the floating plate and the second scroll plate; and a second sealing member arranged between the floating plate and the back pressure plate.

3. The scroll structure according to claim 1, wherein the first scroll plate comprises:

a first plate body; and a first scroll wrap arranged on the first plate body, wherein the first scroll wrap matches the second scroll plate.

4. The scroll structure according to claim 1, wherein the second scroll plate comprises:

a second plate body, wherein the recess is provided at one end of the second plate body facing away from the first scroll plate, the first through hole is provided on the second plate body, and a second through hole is provided on the second plate body; and a second scroll wrap arranged at the other end of the second plate body facing away from the recess.

5. The scroll structure according to claim 1, wherein the back pressure plate comprises:

a back pressure body connected to the second scroll plate, wherein the gap is provided between at least part of an edge of the back pressure body and the side wall of the recess, and a third through hole is provided on the back pressure body; and a protrusion arranged around the third through hole and extending towards one side facing away from the first scroll plate.

6. The scroll structure according to claim 5, further comprising:

a first check valve, wherein a fourth through hole is provided on the second scroll plate, a second chamber is arranged at a position of the back pressure plate corresponding to the fourth through hole, and the first check valve is located in the second chamber and configured to close or open the fourth through hole; and a fifth through hole provided on the back pressure plate, wherein the fifth through hole is in communication with the second chamber and the third through hole.

7. The scroll structure according to claim 1, further comprising:

a screw for fixing the back pressure plate to the second scroll plate; and a third sealing member arranged between the back pressure plate and the second scroll plate.

8. The scroll structure according to claim 1, wherein the floating plate comprises:

a floating plate body, wherein a sixth through hole is provided on the floating plate body, and the back pressure plate passes through the sixth through hole; and a supporting portion arranged on one side of the floating plate body facing away from the first scroll plate, wherein the supporting portion is arranged around the sixth through hole.

9. A compressor comprising:

a casing;

a discharge cover arranged in the casing;

a frame arranged in the casing, wherein the frame is spaced apart from the discharge cover;

the scroll structure according to claim 1, wherein the first scroll plate of the scroll structure is movably arranged on the frame; and a second check valve arranged on the second scroll plate and configured to close or open a second through hole of the second scroll plate.

* * * * *